US009790634B2

(12) United States Patent
Senn et al.

(10) Patent No.: US 9,790,634 B2
(45) Date of Patent: Oct. 17, 2017

(54) TUB INSERT SYSTEM FOR TOP LOADING WASHER

(71) Applicant: Sonoco Development, Inc., Hartsville, SC (US)

(72) Inventors: Jonathan Eugene Senn, Nashville, TN (US); Matthew Marrow, Hendersonville, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/456,852

(22) Filed: Mar. 13, 2017

(65) Prior Publication Data

US 2017/0183805 A1 Jun. 29, 2017

Related U.S. Application Data

(62) Division of application No. 14/285,859, filed on May 23, 2014, now Pat. No. 9,670,611.

(51) Int. Cl.

| | |
|---|---|
| ***D06F 39/00*** | (2006.01) |
| ***B65D 5/02*** | (2006.01) |
| ***B65D 5/18*** | (2006.01) |
| ***B65D 81/05*** | (2006.01) |
| *B65D 85/64* | (2006.01) |

(52) U.S. Cl.

CPC ..... *D06F 39/001* (2013.01); *B65D 5/02* (2013.01); *B65D 5/18* (2013.01); *B65D 81/05* (2013.01); *B65D 85/64* (2013.01); *B65D 2581/053* (2013.01); *B65D 2585/6855* (2013.01)

(58) Field of Classification Search

CPC ..... D06F 39/001; B65D 81/05; B65D 2585/6855; B65D 2581/053; B65D 81/113

USPC ..... 206/320, 521

See application file for complete search history.

(56) References Cited

U.S. PATENT DOCUMENTS

| | | | | |
|---|---|---|---|---|
| 3,184,048 | A * | 5/1965 | Bjerum | D06F 39/001 206/320 |
| 3,187,887 | A * | 6/1965 | Charles | D06F 39/001 206/320 |
| 3,335,849 | A * | 8/1967 | Collin | D06F 39/001 206/320 |
| 3,620,365 | A * | 11/1971 | Elwell | D06F 39/001 206/320 |
| 3,809,232 | A * | 5/1974 | Kennington | B65D 81/113 206/320 |
| 3,812,959 | A * | 5/1974 | Brennan | D06F 39/001 206/320 |
| 3,896,930 | A * | 7/1975 | Collin | D06F 39/001 206/320 |
| 3,901,385 | A * | 8/1975 | Rosen | D06F 39/001 206/320 |

(Continued)

*Primary Examiner* — Steven A. Reynolds
(74) *Attorney, Agent, or Firm* — Miller, Matthias & Hull LLP

(57) ABSTRACT

A washing machine tub insert system is provided that prevents the wash tub from impacting the washing machine cabinet during shipping and handling. The tub insert system may be made from a bottom panel and an insert that lock together. The insert outwardly biases locking members against the cabinet rim and against the tub to minimize relative movement of the tub and cabinet, thereby reducing or eliminating the possibility of the wash tub damaging the washing machine cabinet.

18 Claims, 6 Drawing Sheets

(56) References Cited

U.S. PATENT DOCUMENTS

| | | | | | |
|---|---|---|---|---|---|
| 3,912,076 | A | * | 10/1975 | Elwell | D06F 39/001 206/320 |
| 3,913,736 | A | * | 10/1975 | Brennan | D06F 39/001 206/320 |
| 4,240,550 | A | * | 12/1980 | Collin | D06F 39/001 206/320 |
| 4,366,902 | A | * | 1/1983 | Fanson | B65D 81/113 206/320 |
| 4,700,832 | A | * | 10/1987 | Champ | D06F 39/001 206/370 |
| 4,832,190 | A | * | 5/1989 | Favreau | B65D 85/68 206/320 |
| 5,669,496 | A | * | 9/1997 | Daniels | B65D 77/24 206/320 |

* cited by examiner

TUB INSERT SYSTEM FOR TOP LOADING WASHER

CROSS REFERENCE TO RELATED APPLICATION

This application is a divisional of U.S. patent application Ser. No. 14/285,859, filed May 23, 2014. U.S. application Ser. No. 14/285,859 is incorporated here by reference in its entirety to provide continuity of disclosure.

BACKGROUND

Field of the Invention

This patent relates to appliance packaging. More particularly, this patent relates to a device that fits inside the top opening of a washing machine to prevent the wash tub from moving relative to the outer cabinet during shipping and handling.

Description of the Related Art

Top-loading washing machines generally comprise a wash tub disposed within a cabinet or housing. Some washing machines have a central pivoting agitator extending upwardly from the bottom of the wash tub and operably connected to a motor located below the tub. Other washing machines lack this central agitator and instead have ridges located on the inside of the wash tub to assist with the agitating function. In either type of machine the clearance between the wash tub and the appliance cabinet is often small, and so the cabinet is susceptible to damage from impacts from the wash tub when the appliance is moved during shipping.

Thus there is a need for a device that locks the wash tub in place or otherwise prevents the tub from impacting the appliance cabinet when the washing machine is moved.

SUMMARY OF THE INVENTION

The present invention is a washing machine tub insert system for placement into a washing machine of the type having a wash tub disposed within a cabinet. The tub insert prevents the wash tub from impacting the washing machine cabinet during shipping and handling.

In one aspect the invention is a blank for constructing a unitary tub insert system for a washing machine of the type having a wash tub located within a cabinet, the cabinet having a top surface having a rim defining a top opening having a width W. The blank comprises a bottom panel, a top panel and an insert panel. The bottom panel defines a main panel opening. The top panel is foldably attached to the bottom panel along a first fold line.

The insert panel comprises a first section and a second section. The first section is foldably attached to the top panel along a second fold line. The second section is foldably attached to the first section along a third fold line. The first and second sections are configured to fit within the main panel opening when the insert panel is folded along the third fold line into an elongated, three-dimensional V-shaped structure and the top panel is folded over so that it is overlying the bottom panel.

The insert panel may further comprise a flap foldably attached to the second section along a fourth fold line. The flap is configured to lay flat against the bottom panel when the insert panel is folded along the third fold line into the three-dimensional V-shaped structure and the top panel is folded along the first fold line so that it is overlying the bottom panel.

The bottom panel may comprise a main panel and inwardly opposing tabs connected to the main panel along tab fold lines. The insert panel may be configured to push against and bias the tabs outward, toward the cabinet rim, when the insert panel is folded along the third fold line into a V-shaped structure and the top panel is folded over on top of the bottom panel.

In another aspect, the disclosure relates to a tub insert system made from a folded blank. The system comprises a bottom panel, a top panel, an insert panel and optional foam locking members. The bottom panel comprises a substantially planar main panel configured to overlay the washing machine top opening and opposing tabs foldably attached to the main panel along tab fold lines. The main panel defines a main panel opening. The top panel may be connected to the bottom panel along a first fold line. The top panel overlays the bottom panel.

The insert panel comprises a first section and a second section. The first section is connected to the top panel along a second fold line. The second section is connected to the first section along a third fold line. The first and second sections form an elongated three-dimensional structure having opposing ends. The three-dimensional structure is located on a side of the main panel opposite the top panel, and biases the tabs away from each other.

The optional locking members may be affixed to the outer surface of each tab and may be configured to contact the wash tub and the cabinet.

In another aspect the disclosure relates to a combination washing machine and tub insert system. The washing machine comprises a wash tub located within a cabinet, the cabinet having a top surface having a rim defining a top opening having a width W.

The tub insert system is made from a folded blank and comprises a bottom panel, a top panel, a three-dimensional structure and optional locking members. The bottom panel comprises a substantially planar main panel located adjacent the cabinet top surface and overlying the washing machine top opening. The bottom panel further comprises opposing tabs foldably attached to the main panel along flap fold lines. The main panel defines a main panel opening substantially overlying the washing machine top opening. The top panel 28 may be substantially U-shaped and may be connected to the bottom panel along a first fold line. The top panel overlies the bottom panel.

The three-dimensional structure may be foldably attached to the top panel and have a substantially V-shape profile and opposing ends. The three-dimensional structure extends into the washing machine and biases the tabs away from each other.

The three-dimensional structure may comprise a first section and a second section. The first section may be connected to the top panel along a second fold line. The second section may be connected to the first section along a third fold line. The first and second sections form an elongated three-dimensional structure having a substantially V-shape profile.

The three-dimensional structure may further comprise a flap connected to the second section along a fourth fold line. The flap may be located adjacent the main panel on a side of the main panel away from the cabinet top surface to stabilize the three-dimensional structure.

The optional locking members may be affixed to an outer surface of each tab and configured to contact the wash tub and the cabinet. The three-dimensional structure has a maximum end-to-end length equal to or less than the width W of the washing machine top opening.

THE DRAWINGS

DETAILED DESCRIPTION OF THE INVENTION

Figure 1:
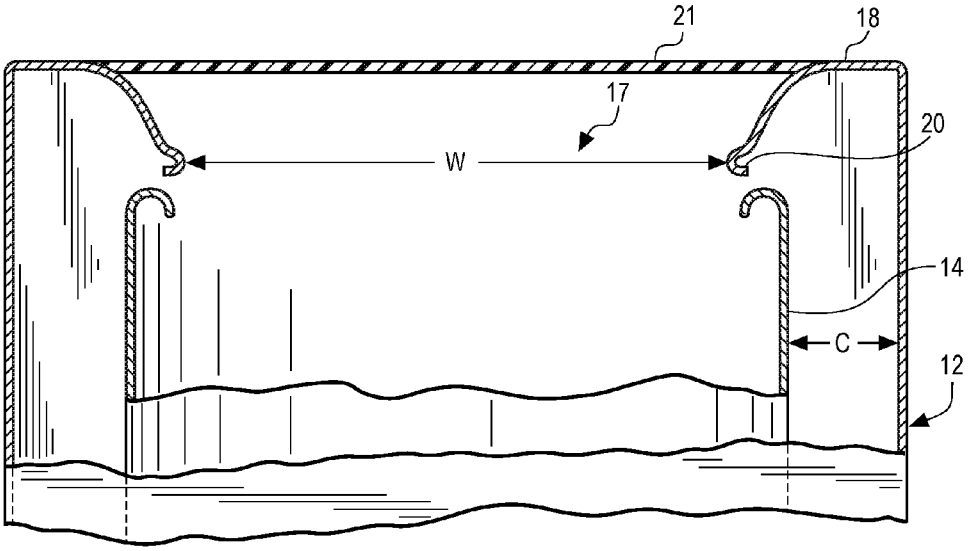
FIG. 1 is a partial cutaway view of a washing machine.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

Turning to the drawings, there is shown in FIG. 1 a partial cutaway view of a washing machine 12 in which the wash tub 14 is located within a metal cabinet 16. The cabinet 16 has an inwardly extending rim 20 that defines a top opening 17 in the washing machine top surface 18. The top opening 17 may have a width W which, if the top opening 17 is circular, is also the diameter of the top opening 17. A hinged lid 21 may cover the top opening 17. A control panel 19, shown only in FIG. 3, may extend upward from the rear of the cabinet 16.

During shipping and handling, the wash tub 14 can swing from its center position and impact the walls of the cabinet 16 from the inside if not restrained. These impacts can produce a cosmetic defect to the outside of the cabinet 16. This problem is solved by placing inside the washing machine 12 a tub insert system 10 made according to the present disclosure.

The Tub Insert System

Figure 2:
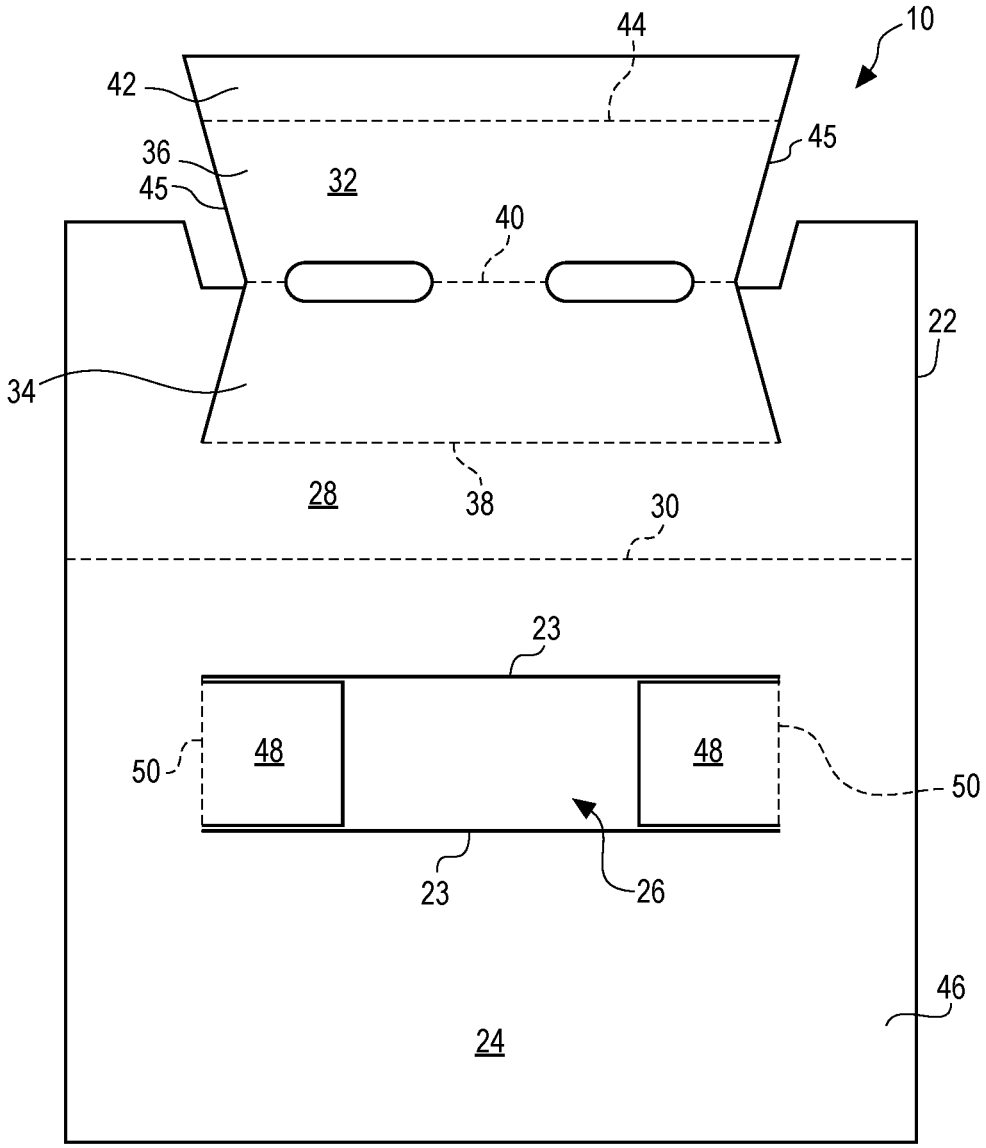
FIG. 2 is a top plan view of a blank for making a tub insert system according to the present invention.

The tub insert system 10 may be formed using a single, unitary blank 22, preferably made of corrugated board. FIG. 2 is a top plan view of a blank 22 for making a tub insert system 10 according to the present disclosure. The blank 22 comprises a substantially rectangular bottom panel 24, a substantially U-shaped top panel 28 and an insert panel 32. The blank 22 preferably is made of corrugated board.

The bottom panel 24 comprises a substantially rectangular main panel 46 and opposing tabs 48 connected to the main panel 46 along tab fold lines 50. The main panel 46 defines a main panel opening 26 which may be rectangular as shown in the figure. The four sides of the rectangular main panel opening 26 may be formed by two opposing, parallel side edges 23 and the two opposing, parallel tab fold lines 50. The main panel opening 26 is configured (sized and positioned) to overlay the washing machine top opening 17 when the tub insert system 10 is installed, allowing the tabs 48 to be folded downward, into the top opening 17.

The top panel 28 is foldably attached to the bottom panel 24 along a first fold line 30. In an alternative embodiment the top panel 28 (and the insert panel 32) together make up a separate piece.

The insert panel 32 comprises a substantially planar first section 34, a substantially planar second section 36, and a flap 42. The first section 34 is connected to the top panel 28 along a second fold line 38 substantially parallel to the first fold line 30. The second section 36 is connected to the first section 34 along a third fold line 40. The flap 42 is connected to the second section 36 along a fourth fold line 44.

As discussed in more detail below with respect to FIGS. 3-5, together the first and second sections 34, 36 form an elongated three-dimensional structure having a substantially V-shape profile, opposing ends 45, and a maximum end-to-end length equal to or less than the width W of the washing machine top opening 17. The third fold line 40 forms a bottom edge of the three-dimensional structure and the second fold line 38 and the fourth fold line 44 form the top edges of the three-dimensional structure. The insert panel 32 is configured so that the three-dimensional structure formed by the first and second sections 34, 36 fits through the main panel opening 26 and into washing machine top opening 17.

Assembly

Figure 3:
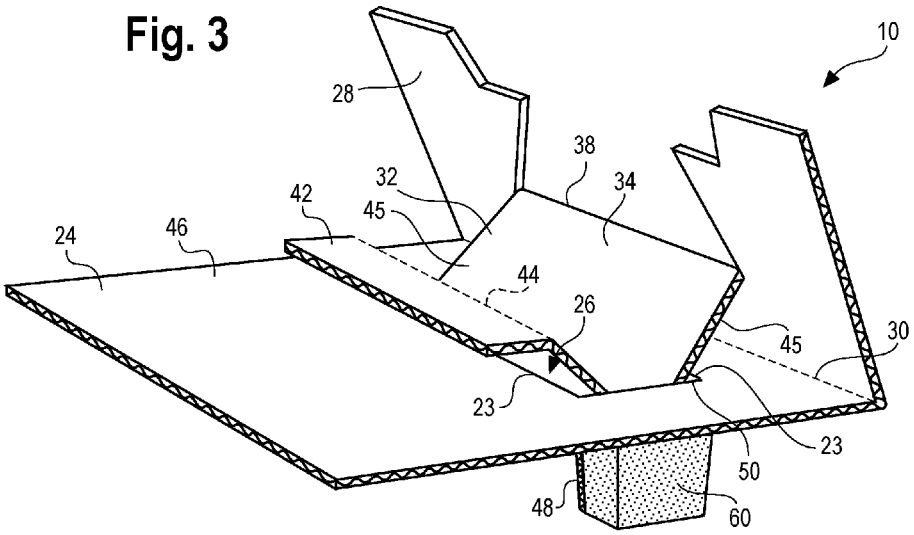
FIG. 3 is a perspective view of a first embodiment of a tub insert system shown partially folded.

FIG. 3 is a perspective view of a first embodiment of a tub insert system 10 according to the present invention, shown in a partially folded state prior to being installed inside a washing machine 12. In this first embodiment the tub insert system 10 comprises the blank 22 and two locking members 60 affixed to the blank 22. The locking members 60 preferably are made of expanded foam material.

To make the tub insert system 10, the blank 22 of FIG. 2 may be folded along fold lines 40 and 44 to form the V-shaped structure. The tabs 48 may be folded downward along fold lines 50 so that their outwardly facing surfaces 49 are facing away from each other as best shown in FIG. 5. The blank 22 may then be folded along fold line 30 until the top panel 28 overlies the bottom panel 24 and the V-shaped structure is inserted through the main panel opening 26 until it contacts the tabs 48 and biases the tabs 48 outward, away from each other. If locking members 60 are used, they may be adhered or otherwise affixed to the outer facing surfaces 49 of the tabs 48. The tub insert system 10 is now ready to be placed over a washing machine opening 17 so that the locking members 60 push against the cabinet rim 20 and against the tub 14 to minimize relative movement of the tub 14 and cabinet 16.

Installation and Use

Figure 4:
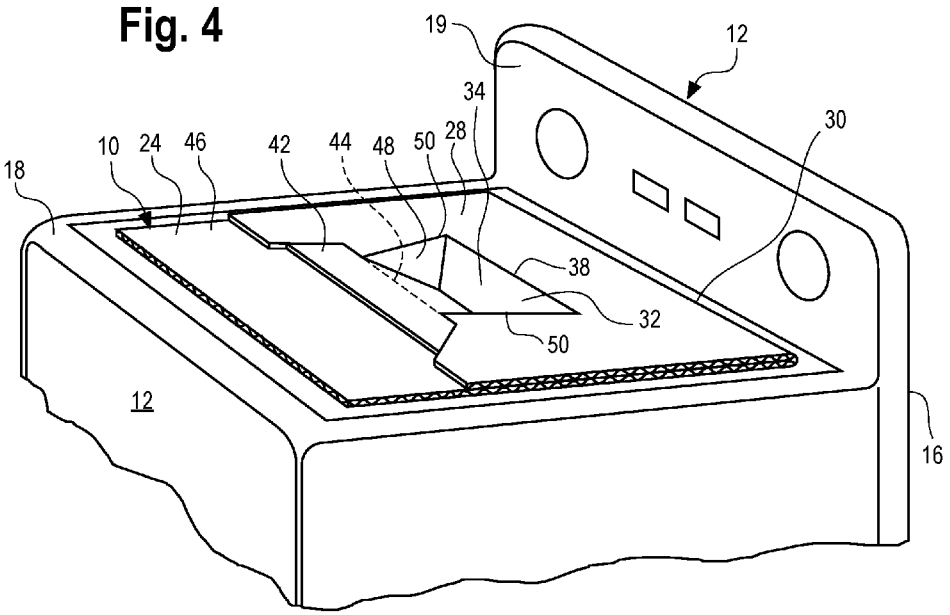
FIG. 4 is a perspective view of the tub insert of FIG. 3 shown completely folded and installed inside a washing machine tub. The washing machine lid is removed for clarity.

FIG. 4 is a perspective view of a first embodiment of a tub insert system 10 installed inside a washing machine 12. The main panel 46 rests against the cabinet top surface 18 and covers all or a portion of the washing machine top opening 17. The top panel 28 is completely folded over on top of the bottom panel 24 and may lay flat against (abut) the bottom panel 24. The insert panel 32 has been folded into a three-dimensional V-shaped structure with its first and second sections 34, 36 suspended below the main panel opening 26 and with the flap 42 lying flat against the bottom panel 24. Preferably the insert panel 32 is configured so that its side edges are substantially coextensive with the side edges 23 of the main panel opening 26 when installed.

Figure 5:
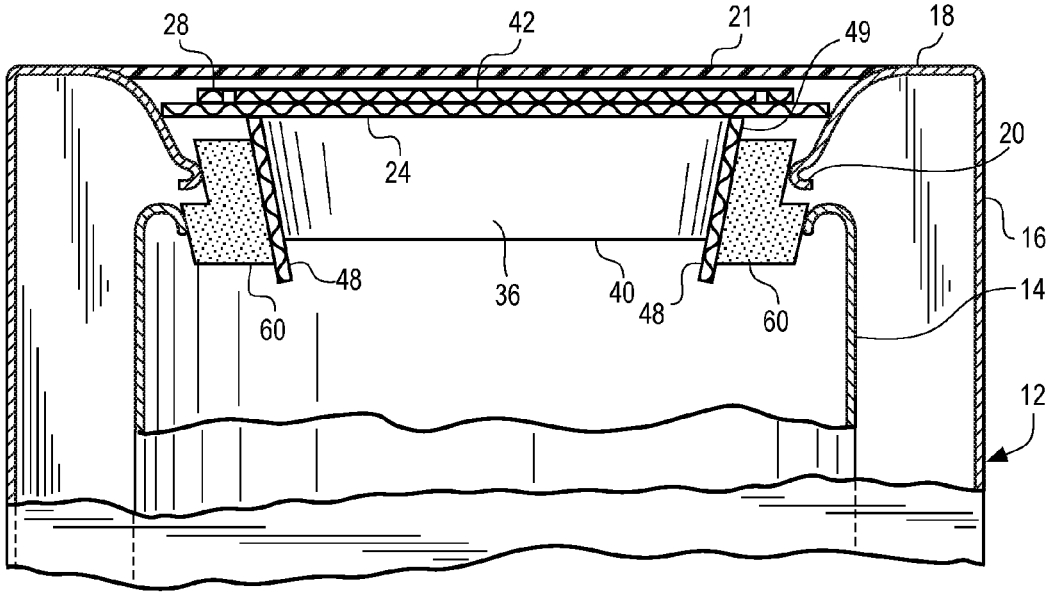
FIG. 5 is a side cutaway view of a tub insert system installed inside a washing machine tub.

FIG. 5 is a side cutaway view of the tub insert system 10 installed inside a washing machine 12. When the tub insert system 10 is installed, the insert panel 32 biases the tabs 48 outwardly. More specifically, the V-shaped structure formed by the first and second sections 34, 36 of the insert panel 32 outwardly biases the tabs 48, and thus the locking members 60, against the cabinet rim 20 and against the tub 14 to minimize relative movement of the tub 14 and cabinet 16, thereby reducing or eliminating the possibility of the wash tub 14 swinging against or otherwise hitting the interior wall of the washing machine cabinet 16.

In this first embodiment the locking members 60 are adhered to the outer facing surfaces 49 of the tabs 48 and contact the wash tub 14 and the cabinet rim 20 to minimize relative movement of the tub 14 and cabinet 16.

Figure 6:
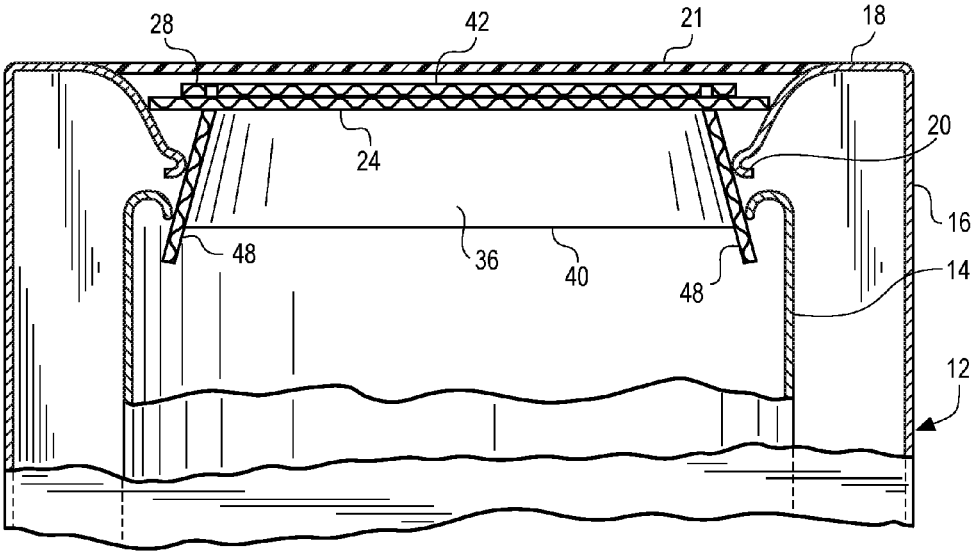
FIG. 6 is a side cutaway view of a second embodiment of a tub insert system installed inside a washing machine tub.

In an alternative embodiment shown in FIG. 6, the tub insert system consists solely of a folded blank and does not include foam locking members 60. Instead, the V-shaped structure formed by the first and second sections of the insert panel outwardly biases the tabs 48 directly against the cabinet rim 20 and against the tub 14 to minimize relative movement of the tub 14 and cabinet 16.

Figure 7:
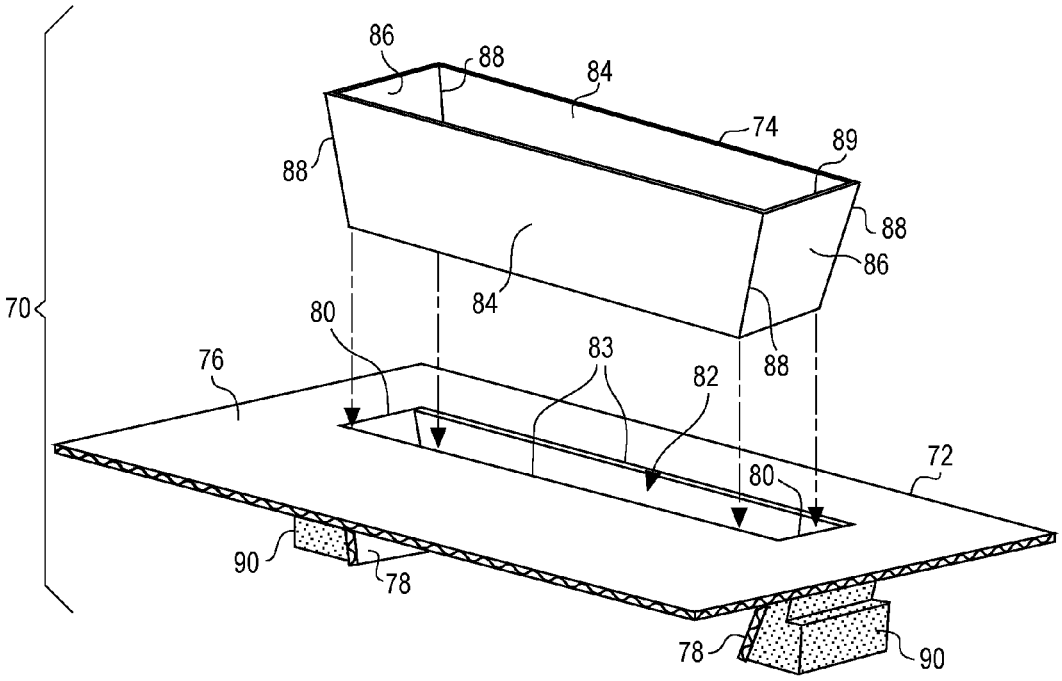
FIG. 7 is an exploded perspective view of an alternative embodiment of a tub insert system according to the disclosure.

In still another embodiment the tub insert system comprises multiple folded blanks, with or without foam locking members 60. For example, as shown in FIG. 7, the tub insert system 70 may comprise a flat bottom panel 72 and an insert 74 that lock together. The bottom panel 72 comprises a substantially rectangular main panel 76 and opposing tabs 78 connected to the main panel 76 along tab fold lines 80. The main panel 76 defines a main panel opening 82 which may be rectangular as shown in the figure. The four sides of the rectangular main panel opening 82 may be formed by two opposing, parallel side edges 83 and the two opposing, parallel tab fold lines 80. The main panel opening 82 is configured (sized and positioned) to overlay the washing machine top opening 17 when the tub insert system 70 is installed, allowing the tabs 78 to be folded downward, into the top opening 17.

The folded insert 74 may comprise two side panels 84 and two end panels 86 joined together along corners 88. The end panels 86 may extend downward from a top edge 89 and may be slanted inwardly (toward each other). The end panels 86 contact and outwardly bias the tabs 78. If no locking members are used, the end panels 86 bias the tabs 78 directly against the cabinet rim 20 and against the tub 14 to minimize relative movement of the tub 14 and cabinet 16. In the embodiment shown in FIG. 7 expanded foam locking members 90 are affixed to the outer facing surface of the tabs 78. The insert 74 and, more specifically, the end panels 86, bias the locking members 90 against the cabinet rim 20 and against the tub 14 to minimize relative movement of the tub 14 and cabinet 16. The insert 74 may be made from folded material such as corrugated or may be a formed or molded three-dimensional structure. The two-dimensional shape defined by the top edge 89 should be larger than the main panel opening 82 to hold the insert 74 in place within the main panel opening 82 and to prevent the insert 74 from falling through the opening 82.

Applications

Thus there has been described a tub insert system for a top loading washing machine that protects the washing machine cabinet from being dented from the inside by the washing machine tub. Preferably the tub insert system is made from a folded corrugated blank and foam locking members. The tub insert system can also be used with dryers having a dryer tub mounted within a cabinet in a fashion similar to that of the washing machine described herein.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A tub insert system comprising:

a bottom panel comprising a substantially planar main panel and opposing tabs foldably attached to the main panel along tab fold lines, the main panel defining a main panel opening; and a separately formed insert disposed within the main panel opening and comprising two side panels and two end panels joined together along corners, the insert having a top edge, the end panels extending downward from the top edge and slanted inwardly toward each other, the end panels contacting the tabs and biasing the tabs away from each other.

2. The tub insert system of claim 1 wherein each tab has an outer facing surface, the tub insert system further comprising:

a locking member affixed to the outer facing surface of each tab.

3. A tub insert system comprising:

a bottom panel comprising a substantially planar main panel and opposing tabs foldably attached to the main panel along tab fold lines, the main panel defining a main panel opening, each tab having an outer facing surface;

a locking member affixed to the outer facing surface of each tab; and an insert disposed within the main panel opening and comprising two side panels and two end panels joined together along corners, the end panels contacting the tabs and biasing the tabs away from each other, wherein the locking members are made from expanded foam material.

4. The tub insert system of claim 3 wherein the bottom panel is made of corrugated board.

5. The tub insert system of claim 4 wherein the insert is made of corrugated board.

6. The tub insert system of claim 4 wherein the insert is a molded three-dimensional structure.

7. The tub insert of claim 1 wherein the bottom panel is made from a first blank and the insert is made from a second blank.

8. The tub insert of claim 1 wherein the main panel opening is rectangular.

9. The tub insert of claim 8 wherein the insert top edge is larger than the main panel opening.

10. A combination washing machine and tub insert system, the washing machine comprising a wash tub located within a cabinet, the cabinet having a top surface having a rim defining a top opening, the top opening having a width, the tub insert system comprising:

a bottom panel comprising a substantially planar main panel and opposing tabs, the main panel located adjacent the cabinet top surface and overlying the washing machine top opening, the opposing tabs foldably attached to the main panel along tab fold lines, the main panel defining a main panel opening; and a separately formed insert disposed within the main panel opening and extending into the washing machine, the insert comprising two side panels and two end panels joined together along corners, the end panels contacting the tabs and biasing the tabs away from each other.

11. The combination washing machine and tub insert system of claim 10 wherein each tab has an outer facing surface, the combination washing machine and tub insert system further comprising:

a locking member affixed to the outer facing surface of each tab.

12. The combination washing machine and tub insert system of claim 11 wherein the locking members are made from expanded foam material.

13. The combination washing machine and tub insert system of claim 12 wherein the bottom panel is made of corrugated board.

14. The combination washing machine and tub insert system of claim 13 wherein the insert is made of corrugated board.

15. The combination washing machine and tub insert system of claim 13 wherein the insert is a molded three-dimensional structure.

16. The combination washing machine and tub insert system of claim 10 wherein the bottom panel is made from a first blank and the insert is made from a second blank.

17. The combination washing machine and tub insert system of claim 10 wherein the insert comprises a top edge that is larger than the main panel opening.

18. The combination washing machine and tub insert system of claim 11 wherein each locking member is configured to impinge against the wash tub and the cabinet.

* * * * *